US009298126B2

(12) United States Patent
Shimizu et al.

(10) Patent No.: US 9,298,126 B2
(45) Date of Patent: Mar. 29, 2016

(54) DEVELOPING DEVICE AND IMAGE FORMING APPARATUS INCLUDING THE SAME

(71) Applicant: KYOCERA Document Solutions Inc., Osaka (JP)

(72) Inventors: Tamotsu Shimizu, Osaka (JP); Akihiro Watanabe, Osaka (JP); Chikara Ishihara, Osaka (JP); Yasuhiro Tauchi, Osaka (JP); Masashi Fujishima, Osaka (JP); Yu Sasaki, Osaka (JP); Hiroaki Sakai, Osaka (JP); Yasuhiro Oishi, Osaka (JP); Yukimasa Watanabe, Osaka (JP)

(73) Assignee: KYOCERA Document Solution Inc., Osaka (JP)

( * ) Notice: Subject to any disclaimer, the term of this patent is extended or adjusted under 35 U.S.C. 154(b) by 0 days.

(21) Appl. No.: 14/671,344

(22) Filed: Mar. 27, 2015

(65) Prior Publication Data

US 2015/0293470 A1 Oct. 15, 2015

(30) Foreign Application Priority Data

Apr. 14, 2014 (JP) ..... 2014-082588

(51) Int. Cl.
*G03G 15/08* (2006.01)

(52) U.S. Cl.
CPC ..... *G03G 15/0808* (2013.01)

(58) Field of Classification Search
None
See application file for complete search history.

(56) References Cited

U.S. PATENT DOCUMENTS

| | | | | |
|---|---|---|---|---|
| 8,112,020 | B2 | 2/2012 | Mabuchi et al. | |
| 2009/0311012 | A1 | 12/2009 | Mabuchi et al. | |
| 2010/0080611 | A1* | 4/2010 | Kurachi et al. | 399/111 |
| 2012/0213549 | A1* | 8/2012 | Mori | 399/111 |
| 2014/0023408 | A1* | 1/2014 | Kato et al. | 399/269 |

FOREIGN PATENT DOCUMENTS

JP 2009-300677 A 12/2009

* cited by examiner

*Primary Examiner* — David Gray
*Assistant Examiner* — Sevan A Aydin
(74) *Attorney, Agent, or Firm* — Studebaker & Brackett PC

(57) ABSTRACT

A developing device includes a housing, a development roller, and a roller gear. The roller gear is disposed at one axial end of the development roller and transmits a rotational drive force to the development roller. The development roller includes a sleeve and a coating layer. The coating layer is formed by dipping the sleeve in a dipping bath with the sleeve directed axially vertically. The development roller is mounted to the housing such that a lower axial end of the development roller at the time of the dipping is an opposite axial end to the one axial end at which the roller gear is disposed.

6 Claims, 5 Drawing Sheets

DEVELOPING DEVICE AND IMAGE FORMING APPARATUS INCLUDING THE SAME

INCORPORATION BY REFERENCE

The present application claims priority under 35 U.S.C. §119 to Japanese Patent Application No. 2014-082588, filed Apr. 14, 2014. The contents of this application are incorporated herein by reference in their entirety.

BACKGROUND

The present disclosure relates to a developing device and an image forming apparatus including the developing device.

Electrographic image forming apparatuses, such as copiers, printers, and facsimile machines, include a developing device that supplies toner to an electrostatic latent image formed on a photosensitive drum thereby to develop the electrostatic latent image. This forms a toner image on the photosensitive drum. The developing device includes a development roller (toner bearing member) rotatably disposed in a housing of the developing device. The development roller is spaced a predetermined gap away from the photosensitive drum and has a circumferential surface for bearing a developer, which at least contains toner. In one disclosure, a development roller is disposed opposite to the photosensitive drum. In another disclosure, a development roller is provided with a resin layer covering the surface of the development roller. In a yet another disclosure, a development roller is formed through a dipping process (dip method, dipping method) of dipping an element tube into a liquid resin in which a resin material has been dissolved.

SUMMARY

One aspect of the present disclosure provides a developing device that includes a housing, a toner bearing member, and a drive transmission section. The drive transmission section is disposed at one axial end of the toner bearing member and configured to transmit a rotational drive force to the toner bearing member. The toner bearing member has a circumferential surface for carrying toner thereon. The toner bearing member is axially rotatable in the housing and disposed a predetermined gap away from an image bearing member. The image bearing member has a circumferential surface on which an electrostatic latent image is formed. The toner bearing member includes a cylindrical base and a surface layer disposed over the base. The surface layer is formed through a dipping process of dipping the base into a dipping bath with the base directed axially vertically. The toner bearing member is mounted to the housing such that a lower axial end of the toner bearing member during the dipping process is an opposite axial end to the one axial end at which the drive transmission section is disposed.

Another aspect of the present disclosure provides an image forming apparatus that includes: the developing device according to the one aspect of the present disclosure described above; and the image bearing member having a circumferential surface on which an electrostatic latent image is formed and configured to receive supply of the toner from the toner bearing member.

DETAILED DESCRIPTION

The following explains an embodiment of the present disclosure with reference to the accompanying drawings. The present disclosure is applicable to electrographic image forming apparatuses, such as copiers, printers, facsimile machines, and multifunction peripherals combining such functions.

Figure 1:
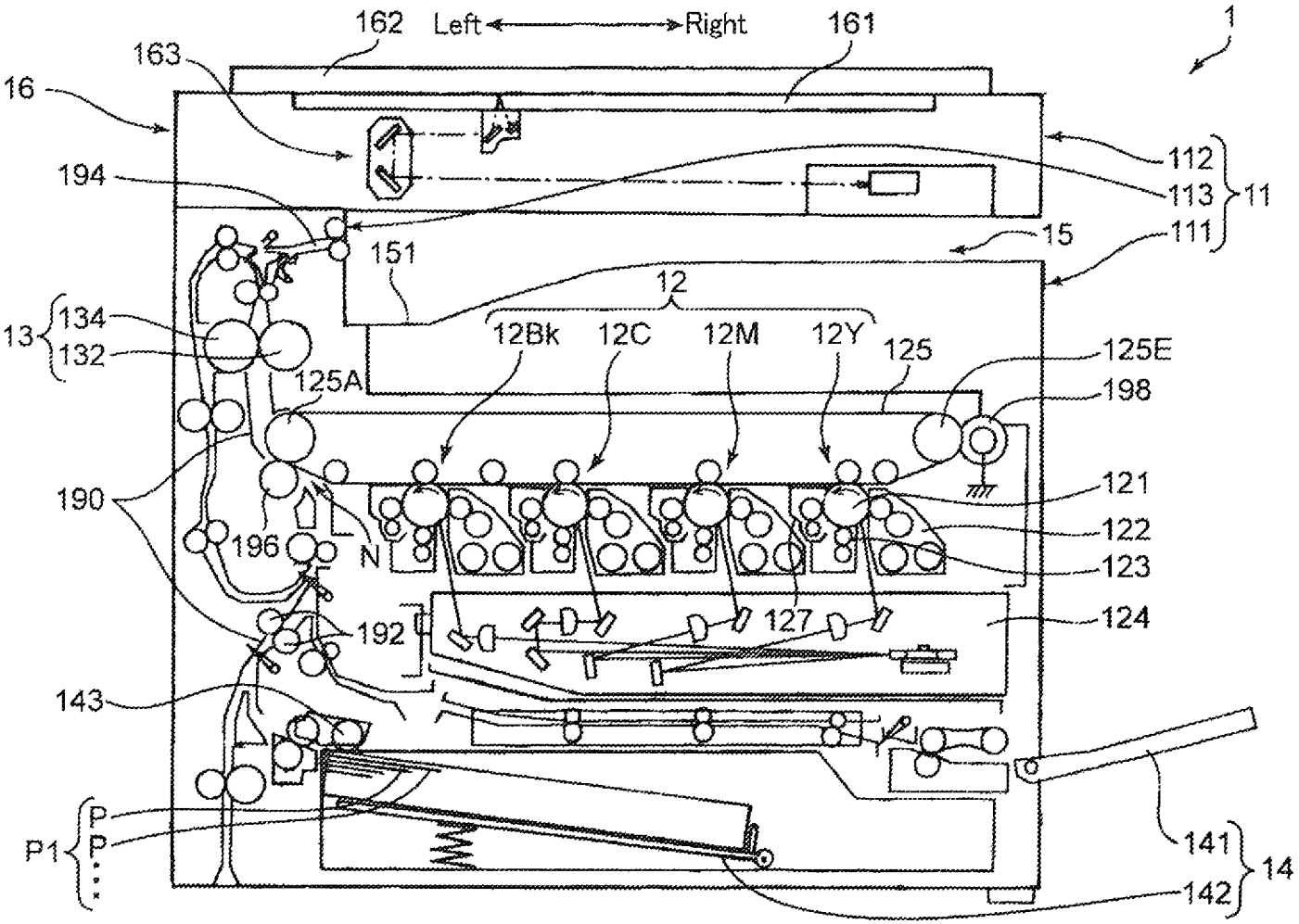
FIG. 1 shows the structure of an image forming apparatus according to an embodiment of the present disclosure.

FIG. 1 shows the structure of an image forming apparatus 1 according to the embodiment of the present disclosure. The image forming apparatus 1 includes a main body 11, an image forming section 12, a fixing device 13, a paper feed section 14, a paper discharging section 15, and a document reading section 16.

The main body 11 is composed of a lower body 111, an upper body 112, and a connecting portion 113. The upper body 112 is disposed above the lower body 111. The connecting portion 113 is disposed between the upper body 112 and the lower body 111, connecting the lower body 111 and the upper body 112 with the paper discharging section 15 secured therebetween. In FIG. 1, the connecting portion 113 upstands from the top-left portion of the lower body 111. The upper body 112 is supported on the top of the connecting portion 113.

The image forming section 12, the fixing device 13, and the paper feed section 14 are disposed in the lower body 111.

The image forming section 12 forms a toner image on a sheet of paper P fed from the paper feed section 14. The image forming section 12 includes an unit 12Y for yellow toner, a unit 12M for magenta toner, a unit 12C for cyan toner, a unit 12Bk for black toner, an intermediate transfer belt 125, a secondary transfer roller 196, and a belt cleaner 198. The units 12Y, 12M, 12C, and 12Bk are disposed in the stated order horizontally from the upstream to downstream in the moving direction of the intermediate transfer belt 125 (from the right to left in FIG. 1). The units 12Y, 12M, 12C, and 12Bk each use toner of a corresponding color, namely yellow, magenta, cyan, or black. The intermediate transfer belt 125 is an endless belt entrained around a plurality of rollers including a drive roller 125A and runs in a sub-scanning direction (the side-to-side direction in FIG. 1) of an image forming process. The secondary transfer roller 196 is pressed against the outer circumferential surface of the intermediate transfer belt 125.

The units 12Y, 12M, 12C, and 12Bk of the respective colors each include a photosensitive drum 121 (image bearing member), a developing device 122, a toner cartridge (not shown), a charger 123, and a drum cleaner 127. Each developing device 122 supplies toner (developer) to the corresponding photosensitive drum 121. Each toner cartridge contains toner of a corresponding color. Below the developing devices 122 adjacent to one another, an exposure device 124 is horizontally disposed for light exposure to the respective photosensitive drums 121.

Each photosensitive drum 121 has a cylindrical shape and is rotated on its axis. The photosensitive drum 121 has a circumferential surface on which an electrostatic latent image is formed and a toner image developed with toner from the electrostatic latent image is carried. The photosensitive drum 121 according to the present embodiment is a known organic photoconductor (OPC). The photosensitive drum 121 has layers, such as a charge generating layer and a charge transport layer, on the surface. These layers are formed through a dipping process, in a manner similar to a development roller 83, which will be described later.

Each developing device 122 supplies toner to an electrostatic latent image formed on the circumferential surface of the corresponding photosensitive drum 121 that is rotating in the direction of the arrow shown in FIG. 1, causing the toner to adhere to the electrostatic latent image. This forms a toner image conforming to the electrostatic latent image on the circumferential surface of the photosensitive drum 121. Each developing device 122 is replenished with toner from the corresponding toner cartridge.

Each charger 123 is disposed immediately under the corresponding photosensitive drum 121 and uniformly charges the circumferential surface of the photosensitive drum 121.

The exposure device 124 is disposed below the chargers 123. The exposure device 124 irradiates the charged circumferential surface of each photosensitive drum 121 with a laser beam in accordance with image data of the corresponding color, thereby forming an electrostatic latent image on the circumferential surface of the photosensitive drum 121. The image data may be input from a computer or the like or acquired by the document reading section 16. The exposure device 124 emits a laser beam to provide a predetermined amount of exposure so as to form a latent image at a predetermined potential on each photosensitive drum 121. Each drum cleaner 127 is disposed on the left of the corresponding photosensitive drum 121 and removes residual toner from the circumferential surface of the photosensitive drum 121.

The intermediate transfer belt 125 is an endless belt. More specifically, the intermediate transfer belt 125 is a conductive soft belt having a multilayered structure with a base layer, an elastic layer, and a coating layer. The intermediate transfer belt 125 is entrained around a plurality of rollers that are aligned substantially horizontally above the image forming section 12. The rollers around which the intermediate transfer belt 125 is entrained include a drive roller 125A and a driven roller 125E. The drive roller 125A is disposed near the fixing device 13 and drives the intermediate transfer belt 125 to rotate. The driven roller 125E is horizontally spaced a predetermined distance away from the drive roller 125A and is rotated by following the rotation of the intermediate transfer belt 125. By a rotational drive force applied to the drive roller 125A, the intermediate transfer belt 125 is driven to circulate clockwise in FIG. 1.

The secondary transfer roller 196 is electrically connected to a section for applying a secondary transfer bias (not shown). A secondary transfer bias is applied between the secondary transfer roller 196 and the drive roller 125A. The transfer bias causes transfer of the toner image formed on the intermediate transfer belt 125 to a sheet P conveyed from a pair of conveyance rollers 192, which is disposed below. The belt cleaner 198 is disposed opposite to the driven roller 125E across the intermediate transfer belt 125.

The fixing device 13 includes a heating roller 132 and a pressure roller 134. In the interior of the heating roller 132, a conductive heating element, such as a halogen lamp, is provided as a heat source. The pressure roller 134 is disposed opposite to the heating roller 132. The fixing device 13 applies heat from the heating roller 132 to a toner image that is transferred to a sheet P by the image forming section 12, carrying out a fixing process of the toner image. The fixing process by the fixing device 13 is conducted while the sheet P passes through the fixing nip formed between the heating roller 132 and the pressure roller 134. After the fixing process, the sheet P having a color image formed thereon is conveyed through a discharge conveyance path 194 extending from the upper portion of the fixing device 13 and discharged to an exit tray 151 disposed on the top of the main body 11.

The paper feed section 14 includes a manual feed tray 141 and a paper feed cassette 142. The paper feed cassette 142 is detachably disposed in the main body 11 at a position below the exposure device 124. The paper feed cassette 142 contains a sheet stack P1, which is a stack of a plurality of sheets P. A pickup roller 143 is disposed above the paper feed cassette 142. The pickup roller 143 feeds a topmost sheet P from the sheet stack P1 stored in the paper feed cassette 142 into a paper conveyance path 190. In FIG. 1, the manual feed tray 141 is disposed on the right-side wall of the main body 11 so as to be freely opened and closed. The manual feed tray 141 is used for manually feeding sheets P to the image forming section 12 one at a time.

The paper conveyance path 190 is disposed to extend vertically on the left of the image forming section 12. The pair of conveyance rollers 192 is disposed at appropriate positions on the paper conveyance path 190. The pair of conveyance roller 192 conveys a sheet P fed from the paper feed section 14 to a secondary transfer nip N formed between the secondary transfer roller 196 and the drive roller 125A.

The paper discharging section 15 is provided between the lower body 111 and the upper body 112. The paper discharging section 15 includes the exit tray 151 formed in the top surface of the lower body 111. The exit tray 151 is for receiving a sheet P discharged after the fixing process of the sheet P by the fixing device 13.

The document reading section 16 is disposed in the upper body 112. The document reading section 16 includes contact glass 161, a document holding cover 162, and a scanning mechanism 163. The contact glass 161 is for placing a document thereon. The document holding cover 162 is freely opened and closed to hold a document placed on the contact glass 161. The scanning mechanism 163 scans the document placed on the contact glass 161 to read an image of the document. The scanning mechanism 163 includes an image sensor, such as charge coupled device (CCD) or a complementary metal oxide semiconductor (CMOS), to optically read an image of the document and generates image data representing the image. The main body 11 includes an image processing section (not shown) for creating an image for printing based on the image data.

Structure of Developing Device

Figure 2:
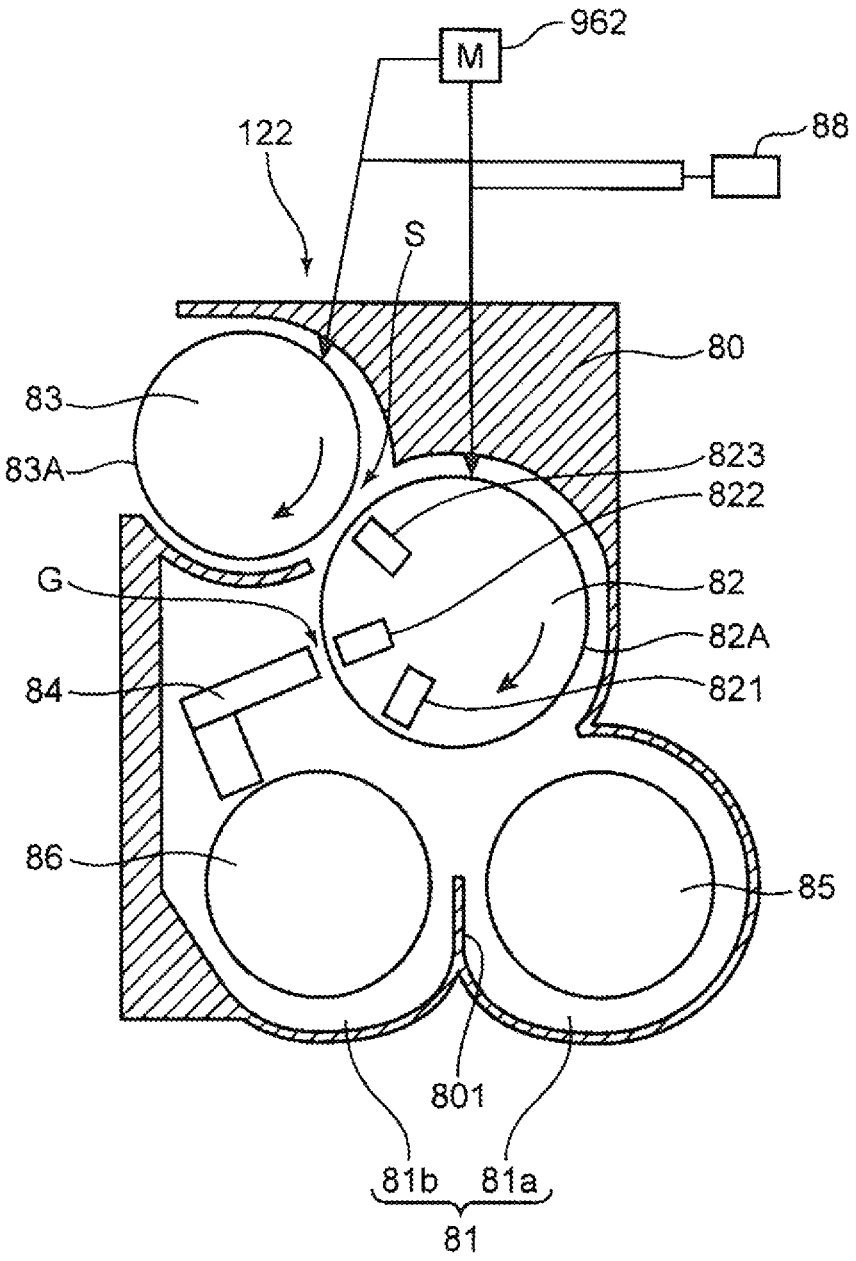
FIG. 2 is a side view showing the structure of a developing device according to the embodiment of the present disclosure.
Figure 3A:
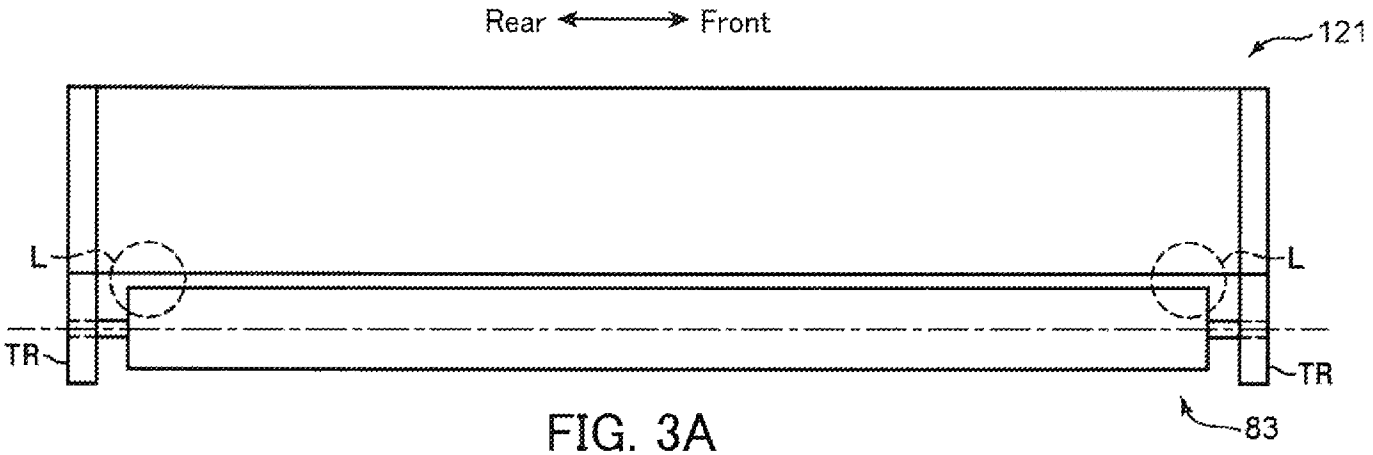
FIG. 3A shows the relative axial lengths of a photosensitive drum and a development roller both according to the embodiment.
Figure 3B:
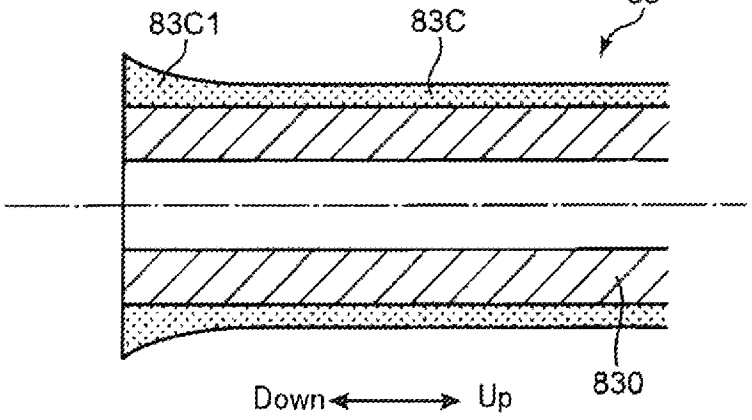
FIG. 3B is a cross-sectional view showing an end portion of the development roller, illustrating the thicknesses of a layer residing on the development roller.
Figure 4B:
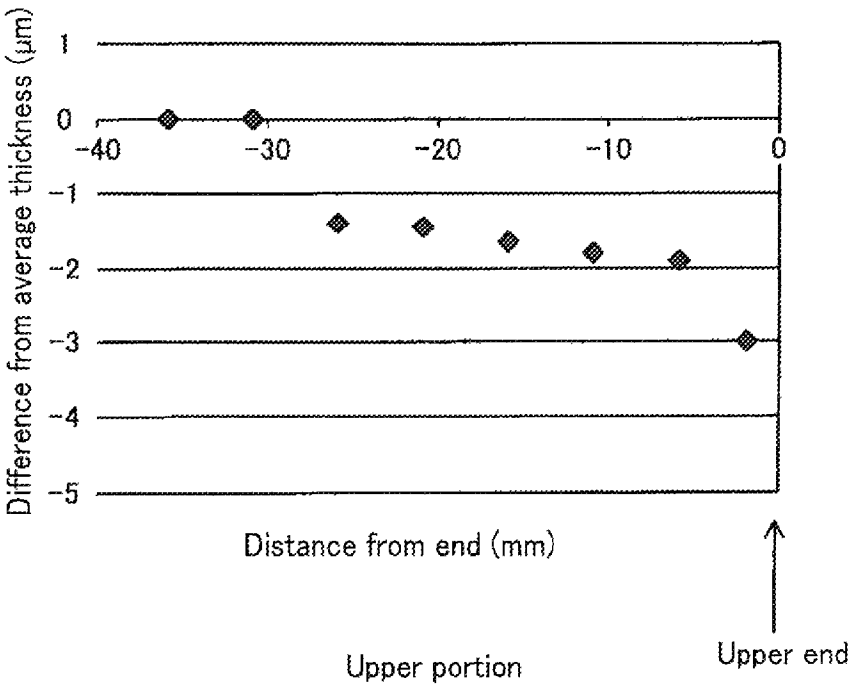
FIGS. 4A and 4B are graphs each plotting the thickness distribution of the layer in an axial direction of the development roller according to the embodiment, FIG. 4A directed to a portion of the development roller that is a lower portion during a dipping process and FIG. 4B directed to a portion of the development roller that is an upper potion during the dipping process.
Figure 4A:
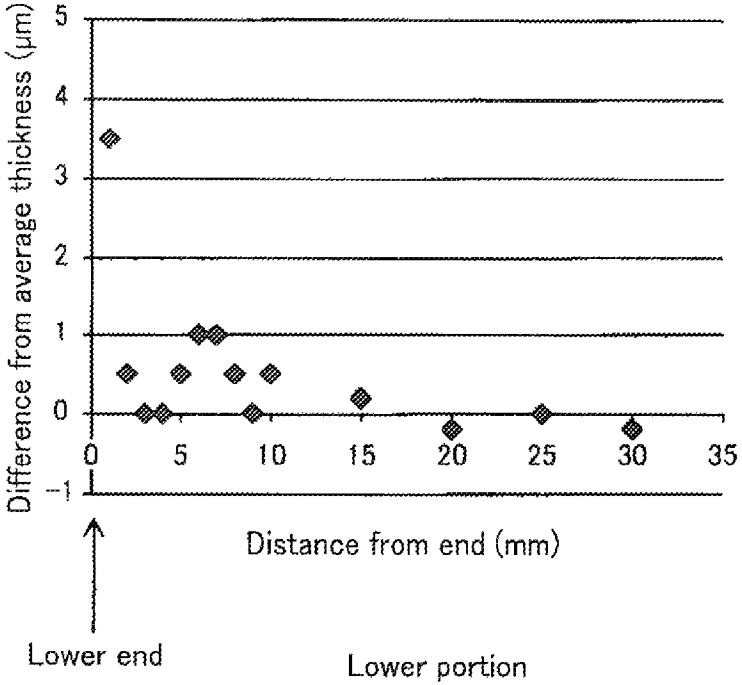
Figure 5:
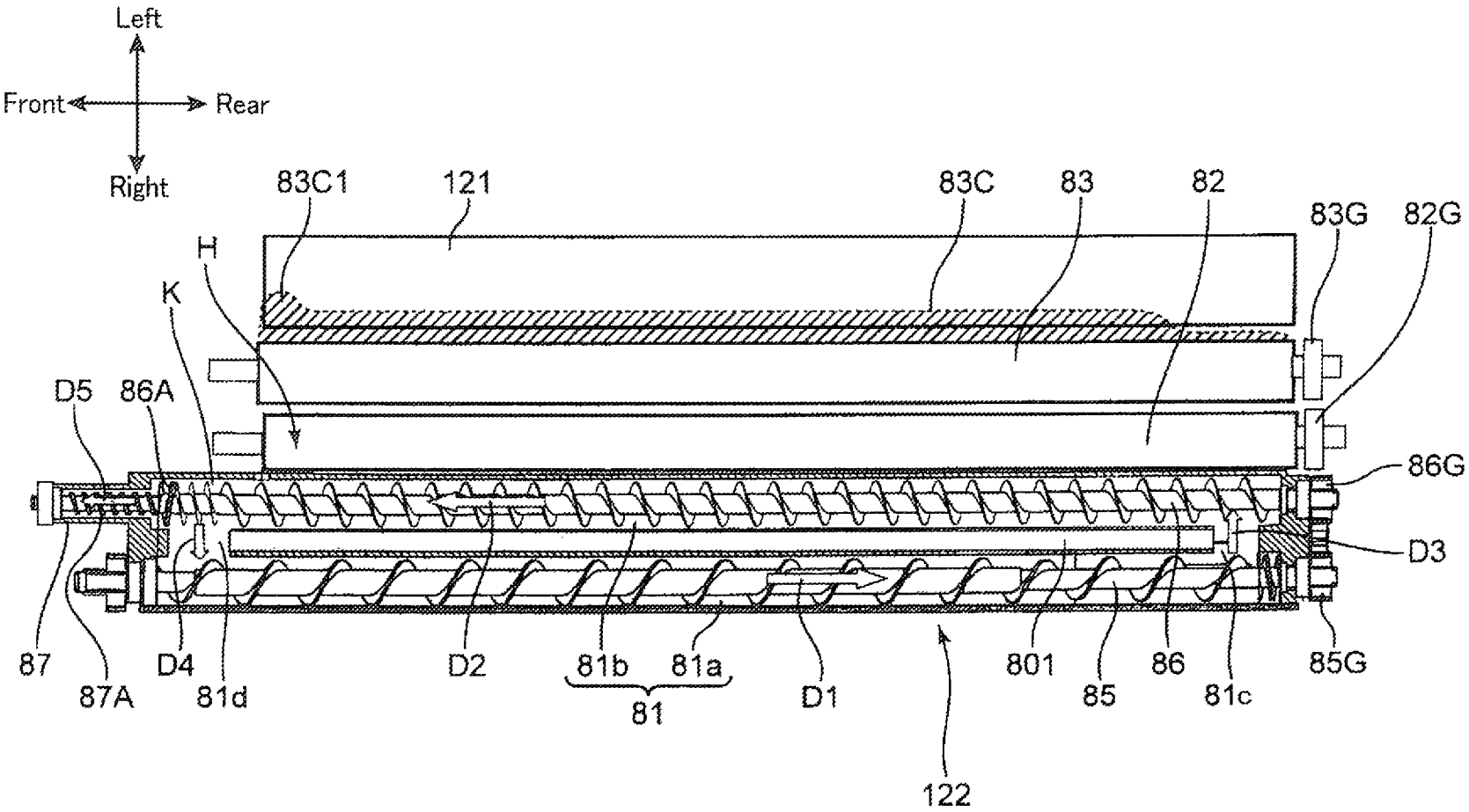
FIG. 5 is a plan view of the developing device according to the embodiment of the present disclosure.

The following explains the developing device 122 in detail. FIG. 2 is a side view showing the structure of the developing device 122. FIG. 3A shows the relative axial lengths of the photosensitive drum 121 and the development roller 83 both according to the present embodiment. FIG. 3B is a cross-sectional view of an end portion of the development roller 83, illustrating the thicknesses of a layer residing on the development roller 83. FIGS. 4A and 4B are graphs each plotting the layer thickness distribution in an axial direction of the development roller 83. More specifically, FIG. 4A is a graph plotting the layer thickness distribution at a portion of the development roller 83 that is a lower portion during the dipping process, and FIG. 4B is a graph plotting the layer thickness distribution at a portion of the development roller 83 that is an upper end during the dipping process. FIG. 5 is a plan view of the developing device 122 according to the present embodiment. For the purpose of explanation, FIG. 5 shows a magnetic roller 82 and the development roller 83 each at a position displaced leftward. The developing device 122 according to the present embodiment employs a touchdown developing method involving the use of the development roller 83 and the magnetic roller 82. As shown in FIG. 2. the developing device 122 includes a development housing 80 (housing) defining the interior space of the developing device 122. The development housing 80 has a developer reservoir 81 (developer storing section) in which a developer is retained. The developer contains: non-magnetic toner that is chargeable to a predetermined polarity; and magnetic carrier. The development housing 80 houses therein the magnetic roller 82 (developer bearing member), the development roller 83 (toner bearing member), and a developer limiting blade 84 (layer-thickness limiting member). The magnetic roller 82 is disposed above the developer reservoir 81. The development roller 83 is disposed opposite to the magnetic roller 82 at a position diagonally above the magnetic roller 82. The developer limiting blade 84 is disposed opposite to the magnetic roller 82. The developing device 122 additionally includes a driving section 962 and a developing bias applying section 88.

As shown in FIGS. 2 and 5, the developer reservoir 81 includes a first chamber 81*a* and a second chamber 81*b* extending in the longitudinal direction of the developing device 122 so as to be adjacent to each other. The second chamber 81*b* is disposed opposite to the magnetic roller 82. The first chamber 81*a* and the second chamber 81*b* are partitioned from each other with a partition plate 801 extending integrally from the development housing 80 in the longitudinal direction. The first chamber 81*a* and the second chamber 81*b* are in communication through a first connecting portion 81*c* and a second connecting portion 81*d* disposed at the ends opposing in the longitudinal direction (axial ends) of the respective chambers 81*a* and 81*b*. The first chamber 81*a* and the second chamber 81*b* respectively accommodate a first screw feeder 85 and a second screw feeder 86 (conveyance member) each axially rotate to convey the developer while stirring. The first screw feeder 85 and the second screw feeder 86 are driven to rotate by the driving section 962. The first screw feeder 85 and the second screw feeder 86 are set to rotate in the mutually opposite directions. With the above arrangement, the developer is circulated through the first chamber 81*a* and the second chamber 81*b* in a path indicated by the arrows D1, D3, D2, and D4 shown in FIG. 5 while being stirred. The stirring of the developer in the manner described above mixes the toner and the carrier to charge the toner to, for example, a positive polarity. The first screw feeder 85 is provided with a first screw gear 85G at the rear end, and the second screw feeder 86 is provided with a second screw gear 86G at the rear end.

As shown in FIG. 2, the magnetic roller 82 is rotatably disposed in the development housing 80 and extends in the longitudinal direction of the developing device 122 at a position opposite to the development roller 83. The magnetic roller 82 is driven to rotate clockwise shown in FIG. 2. The magnetic roller 82 is provided with a fixed magnet roll (fixed magnet) in its interior. The magnet roll has a plurality of polarities, namely a pump pole 821, a limiting pole 822, and a main pole 823. The pump pole 821 is disposed opposite to the developer reservoir 81, the limiting pole 822 is disposed opposite to the developer limiting blade 84, and the main pole 823 is disposed opposite to the development roller 83.

By the magnetic force of the pump pole 821, the magnetic roller 82 magnetically pumps up (attracts) the developer from the developer reservoir 81 onto its circumferential surface 82A. The magnetic roller 82 magnetically holds a layer of the attracted developer (magnetic brush layer) on the circumferential surface 82A. The magnetic roller 82 then supplies toner to the development roller 83. As the magnetic roller 82 rotates, the developer is conveyed toward the developer limiting blade 84.

The developer limiting blade 84 is disposed opposite to the magnetic roller 82 at a position upstream from the development roller 83 in the rotation direction of the magnetic roller 82. The developer limiting blade 84 limits the thickness of the developer accumulated on the circumferential surface 82A of the magnetic roller 82. The developer limiting blade 84 defines a limiting gap G of a predetermined size with the circumferential surface 82A of the magnetic roller 82. The arrangement described above ensures that the developer layer formed on the circumferential surface 82A to have a uniform predetermined thickness.

The development roller 83 is disposed to extend in parallel to the magnetic roller 82 and driven to rotate clockwise shown in FIG. 2. The development roller 83 is disposed opposite to the photosensitive drum 121 shown in FIG. 1. The development roller 83 has a cylindrical shape and disposed in the development housing 80 so as to be axially rotatable. Throughout its rotation, the development roller 83 stays in contact with the developer layer held on the circumferential surface 82A of the magnetic roller 82. The development roller 83 receives toner form the developer layer held on the circumferential surface 82A of the magnetic roller 82 and holds a layer of the received toner. The development roller 83 has a circumferential surface 83A on which the toner layer is held. In the developing process, the development roller 83 supplies toner from the toner layer to the circumferential surface of the corresponding photosensitive drum 121. As shown in FIG. 3B, the development roller 83 according to the present embodiment includes a cylindrical sleeve 830 (base) and a resin coating layer 83C (nylon coat, surface layer) formed on the circumferential surface of the sleeve 830.

As shown in FIG. 2, the development roller 83, the magnetic roller 82, the first screw feeder 85, and the second screw feeder 86 are all driven to rotate by the driving section 962. As shown in FIG. 5, a roller gear 83G (drive transmission section) is fixed at the rear end of the development roller 83. In addition, an input gear 82G is fixed at the rear end of the magnetic roller 82. The driving section 962 (see FIG. 2) is a motor that generates a rotational drive force. The driving section 962 is coupled to the input gear 82G The rotational drive force input to the input gear 82G is transmitted to the roller gear 83G and the second screw gear 86G The roller gear 83G transmits the rotational drive force to the development roller 83. The second screw gear 86G transmits the rotational drive force to the second screw feeder 86. The second screw gear 86G is also coupled to the first screw gear 85G The first screw gear 85G transmits the rotational drive force to the first screw feeder 85. Consequently, the rotational drive force generated by the driving section 962 rotates the development roller 83, the magnetic roller 82, the first screw feeder 85, and the second screw feeder 86 in synchronism.

As shown in FIG. 2, a gap S of a predetermined size is secured between the circumferential surface 83A of the development roller 83 and the circumferential surface 82A of the magnetic roller 82. The gap S is set to be 0.3 mm, for example. The development roller 83 is disposed to face the photosensitive drum 121 (see FIG. 1) through an opening formed in the development housing 80 and has a gap of a predetermined size between the circumferential surface 83A and the circumferential surface of the photosensitive drum 121. In the present embodiment, the gap is set to be 0.12 mm.

The developing bias applying section 88 applies a developing bias, which is generated by superimposing an alternating-current (AC) voltage on a direct-current (DC) voltage, to the magnetic roller 82 and the development roller 83. An AC voltage is applied between the photosensitive drum 121 and the development roller 83 as well as between the development roller 83 and the magnetic roller 82. As a consequence, toner is supplied from the magnetic roller 82 to the development roller 83 and subsequently from the development roller 83 to the photosensitive drum 121. The development roller 83 therefore receives a higher AC voltage for causing the toner transfer, as compared with a known one-component or two-component developing device.

As shown in FIG. 5, the developing device 122 additionally includes a reverse conveyance section 86A (developer retaining section) and a developer discharging section 87. The reverse conveyance section 86A is a screw impeller coaxially fixed to the second screw feeder 86 at the front end of the second chamber 81*b*. The screw impeller constituting the reverse conveyance section 86A is disposed to have a feeding direction that is reverse to the feeding direction of the screw impeller of the second screw feeder 86. The reverse conveyance section 86A is disposed opposite to the front end of the second connecting portion 81*d*. The reverse conveyance section 86A rotates integrally with the second screw feeder 86 to push back the developer conveyed by the second screw feeder 86, causing some of the developer to be retained there.

The developer discharging section 87 is in communication with the second chamber 81*b* at a position forward of the reverse conveyance section 86A. The developer discharging section 87 includes a cylindrical wall defining an interior space and a discharge screw 87A rotatable in the interior space. The discharge screw 87A is a screw impeller coaxially fixed to the second screw feeder 86. The discharge screw 87A is disposed to have the same feeding direction as the screw impeller of the second screw feeder 86. Some of the developer once retained by the reverse conveyance section 86A passes over the reverse conveyance section 86A to flow into the developer discharging section 87. The developer flown into the developer discharging section 87 is conveyed forward by the discharge screw 87A and discharged from an exit port not shown in the figures. As has been described above, the present embodiment employs a trickle technique for causing some of the developer to be discharged from the developing device 122. To replenish the developing device 122 with carrier, the toner cartridge (not shown) may contain carrier in addition to toner or the developing device 122 may be provided with a carrier replenishing tank.

As shown in FIG. 3A, the photosensitive drum 121 according to the present embodiment has an axial length that is longer than the axial length of the development roller 83. Therefore, the axial ends of the development roller 83 correspond in position to regions L of the photosensitive drum 121, the regions L being located axially inwardly of the axial ends of the photosensitive drum 121. The development roller 83 is provided with a pair of tracking rollers TR one at each axial end. The tracking rollers TR abut against the end portions of the photosensitive drum 121, thereby determining the gap between the development roller 83 and the photosensitive drum 121. The development housing 80 is urged toward the photosensitive drum 121 by biasing springs (not shown). Consequently, the gap between the development roller 83 and the photosensitive drum 121 is stably maintained.

As show in FIG. 3B, the sleeve 830 of the development roller 83 is made from aluminum. The coating layer 83C of the development roller 83 is formed through a dipping process explained below. First, the outer circumferential surface of the sleeve 830 is anodized to form an anodized layer (oxidized layer) having a thickness of 10 μm. The presence of an oxidized layer on the sleeve 830 that is made from aluminum increases the adhesion strength of the coating layer 83C to the base. Thus, detachment of the coating layer 83C is restricted. Then, the surface of the sleeve 830, that is, the surface of the anodized layer is heated at 120° C. for 10 minutes or longer. The heat treatment is conducted to intentionally cause cracking in the sleeve 830 so as to reduce or prevent cracking during the process of drying the coating layer 83C. The duration of the heat treatment is determined in advance to be equal to or longer than the time taken for the drying process, for example. The heat treatment is conducted always at a constant temperature and for a constant duration. This ensures that all of sleeves 830 subjected to the heat treatment will have an approximately constant amount of cracking. Subsequently to the heat treatment described above, a process of forming the coating layer 83C on the anodized layer is conducted. More specifically, a liquid mixture is prepared by mixing: an alcohol-soluble nylon resin as a binder resin; titanium oxide as a conducting material; 800 parts by mass of methanol as a dispersion medium; and zirconia beads measuring 1.0 mm in diameter. The mixing is carried out for about 48 hours by using a ball mill. The anodized sleeve 830 is dipped into the liquid mixture for a predetermined time period and removed from the liquid mixture. Then, the sleeve 830 is dried for 10 minutes in a high temperature environment of 130° C. Note that the sleeve 830 is dipped into the liquid mixture with the axial direction of the cylindrical shape directed vertically. Through the dipping process described above, the coating layer 83C coating the sleeve 830 is formed to a thickness ranging from 2 μm to 11 μm. As described above, prior to the coating of the anodized layer with the coating layer 83C, cracking is caused in the anodized layer by a heat treatment. This is effective to prevent the conductive material contained in the coating layer 83C to be localized under the influence of convection caused in the coating layer 83C during the process of drying the coating layer 83C. Consequently, the conductive material is ensured to be uniformly dispersed in the resultant coating layer 83C.

Yet, forming the coating layer 83C through the dipping process as described above involves that the liquid mixture adhering on the surface of the sleeve 830 tends to flow down by gravity when the sleeve 830 is lifted up from the liquid mixture. As a consequence, the coating layer 83C formed on the surface of the sleeve 830 is thicker at a portion closer to an axial end of the sleeve 830 that was the lower axial end during the dipping than at a portion corresponding to the axial center of the sleeve 830. In particular, the coating layer 83C tends to have a thicker portion 83C1 at a position corresponding to the lower axial end (the front end in FIG. 3) of the sleeve 830. In addition, the coating layer 83C tends to have a thinner portion at a position closer to an axial end of the sleeve 830 that was the upper axial end during the dipping process than at a portion corresponding to the axial center of the sleeve 830.

FIG. 4A is a graph plotting the layer thickness distribution of the coating layer 83C at the lower portion of the sleeve 830. FIG. 4B is a graph plotting the thickness distribution of the coating layer 83C at the upper portion of the sleeve 830. In each graph, the horizontal axis represents the distance from the corresponding end (upper or lower end) of the sleeve 830, whereas the vertical axis represents the difference from the average thickness of the coating layer 83C. More specifically, the vertical axis represents the thickness of the coating layer 83C at the respective axial positions of the development roller 83, by plotting the difference from the average thickness of the coating layer 83C. As shown in FIGS. 4A and 4B, with respect to the upper portion of the coating layer 83C, a thinner portion extends for a length (30 mm) that is longer than the length of a portion that is thicker than the average (15 mm) In addition, the thickness reduction (3 μm) of the coating layer 83C at the upper portion is close to the value of the thickness increase (3.5 μm) of the coating layer 83C at the lower portion.

FIG. 5 exaggerates the thickness distribution of the coating layer 83C coating the development roller 83. As described above, according to the present embodiment, the coating layer 83C is formed by dipping the sleeve 830 into a dipping bath with the axial direction of the development roller 83 directed vertically. The development roller 83 is mounted to the development housing 80 such that the lower axial end of the development roller 83 at the time of the dipping is the front end that is opposite from the roller gear 83G (from the rear end).

The development roller 83 is pressed at the rear end toward the photosensitive drum 121 due to the meshing of the gear teeth between the input gear 82G and the roller gear 83G that is caused upon transmission of the rotational drive force from the input gear 82G to the roller gear 83G. Thus, at the rear end portion of the development roller 83, the gap between the development roller 83 and the photosensitive drum 121 is stably maintained by the pair of tracking rollers TR described above. At the front end portion of the development roller 83, on the other hand, the development roller 83 may not be reliably positioned due to the absence of the pressing force produced by the input gear 82G and the roller gear 83G meshing with each other in a manner described above. The development roller 83 may wobble or may be off centered within predetermined tolerances. Under the influence by these factors, the gap between the development roller 83 and the photosensitive drum 121 tends to fluctuate at the front end portion of the development roller 83. When the gap between the development roller 83 and the photosensitive drum 121 is larger at the front end portion of the development roller 83 than at the rear end portion, toner images formed on the photosensitive drum 121 suffer from reduction in image density or inconsistency in image density appearing at intervals corresponding to the rotation pitch of the development roller 83.

According to the present embodiment, the coating layer 83C is relatively thicker at a portion closer to an end that was the lower end of the development roller 83 during the dripping process, and the development roller 83 is mounted to the developing device 122 such that the relatively thicker portion of the coating layer 83C is positioned toward the front of the developing device 122. Therefore, by the difference in the thickness of the coating layer 83C, the gap between the development roller 83 and the photosensitive drum photosensitive drum 121 is narrower in part, and the developing electric field at such a portion is maintained relatively strong. This can restrict the reduction or inconsistency in image density at the front end portion (opposite to the driving end) of the developing device 122.

Note in addition that the present embodiment employs a touchdown developing method as described above. In the developing device 122, a magnetic brush is formed from toner and carrier on the circumferential surface of the magnetic roller 82. The strong abrasive force of the magnetic brush results in wear of the coating layer 83C of the development roller 83. The abrasive force of the magnetic brush fluctuates according to the concentration of the toner in the magnetic brush. When the concentration of the toner is low and thus the carrier surfaces tend to be exposed, the abrasive force of the magnetic brush increases to accelerate wear of the coating layer 83C. As shown in FIG. 5, the second screw feeder 86 gradually supplies the developer to the magnetic roller 82 while conveying the developer forward. In addition, as the toner on the development roller 83 is consumed, the developer with a low toner concentration is appropriately collected into the second chamber 81*b*. Consequently, the concentration of the toner in the second chamber 81*b* is gradually lower from the rear toward the front. Thus, the concentration of the toner in the developer carried on the magnetic roller 82 is relatively lower toward the front end of the magnetic roller 82. Therefore, as explained above, the abrasive force of the magnetic brush on the magnetic roller 82 is greater in a specific region (region H shown in FIG. 5). This phenomenon is particularly notable when the image forming apparatus 1 continuously prints images at a high coverage rate.

According to the present embodiment, the coating layer 83C is relatively thicker at a portion closer to an end of the development roller 83 that was the lower end during the dipping process, and the development roller 83 is mounted to the developing device 122 such that the lower end of the coating layer 83C is positioned toward the front of the developing device 122. As a consequence, despite the strong abrasive force of the magnetic brush, the portion of the coating layer 83C closer toward the front is restricted from becoming thinner than the portion closer toward the rear. In addition, the arrangement described above is effective to prevent detachment of the coating layer 83C by a mechanical force applied by the magnetic brush. Note that, at the front end portion of the magnetic roller 82, the concentration of the toner tends to be lower and thus the chargeability of the toner tends to be higher. As a result, the toner carried on the front end portion of the development roller 83 may be in sufficient to appropriately develop a latent image on the photosensitive drum 121, which tends to cause reduction in the resulting image density. Yet, as described above, the gap between the photosensitive drum 121 and the development roller 83 is set to be partially narrower at a position closer to the front end of the development roller 83 which promotes the developing action and thus prevents the image density reduction.

The developing device 122 according to the present embodiment has the developer discharging section 87. Components, carrier in particular, of the developer are gradually replaced while the carrier is held in the developer reservoir 81, which increases the longevity of the developer. Consequently, the present embodiment ensures stable image formation over a long period of time. With reference to FIG. 5, it is noted that the developer in the second chamber 81*b* has high fluidity in the downstream end portion and thus can be readily discharged. By the reverse conveyance section 86A, some of the developer is retained to form accumulation K. Most of the accumulation K is conveyed through the second connecting portion 81*d* to the first chamber 81*a*. In addition, as described above, some of the developer passes over the reverse conveyance section 86A and is discharged from the developer discharging section 87.

The accumulation K formed in the downstream end portion of the second chamber 81*b* leads to an increase in the amount of the developer carried on the front end portion of the circumferential surface of the magnetic roller 82. Consequently, the amount of the developer that is carried beyond the developer limiting blade 84 is greater at the front end portion than at the rear end portion. This leads to a further increase of the abrasive force of the magnetic brush. As has been described above, the development roller 83 is mounted such that the lower end during the dipping process is disposed toward the front of the developing device 122. This restricts the coating layer 83C from becoming thin even in the structure that the developer discharging section 87 is disposed at the downstream of the second chamber 81*b*.

The explanation given above is directed to the developing device 122 and the image forming apparatus 1 according to the embodiment of the present disclosure. However, the present disclosure is not limited to the specific embodiment, and various alterations including the following may be made.

(1) In the embodiment given above, the image forming apparatus 1 is explained as being a full color image forming apparatus, which should not be construed as a limitation. The image forming apparatus 1 may be a monochrome image forming apparatus that prints black and white images.

(2) In the embodiment above, the second screw feeder 86 conveys developer from the side closer to the roller gear 83G, which should not be construed as a limitation. The second screw feeder 86 may convey the developer toward the side closer to the roller gear 83G Alternatively, the second screw feeder 86 may convey the developer in a direction toward the thicker portion 83C1 (the lower end of the development roller 83 at the time of the dipping) irrespective of the disposition of the roller gear 83G Similarly, the developer discharging section 87 may be disposed in accordance with the lower end of the development roller 83 at the time of the dipping, irrespective of the disposition of the roller gear 83G.

EXAMPLES

Now, the following explains a preferred manner of the development roller 83 of the developing device by way of example. Examples given below were subjected to experiments in the following conditions.

Experimental Conditions

- Printing rate: 30 sheets/min
- Photosensitive drum 121: OPC drum
- Peripheral speed of the photosensitive drum 121: 180 mm/sec
- Development roller 83: anodized surface treatment+nylon resin coating
- Peripheral speed of the development roller 83: Ratio of 1.5 relative to the peripheral speed of the photosensitive drum 121 (the same rotation direction as the photosensitive drum 121)
- Peripheral speed of magnetic roller: Ratio of 1.1 relative to the peripheral speed of the development roller 83 (the opposite rotation direction from the photosensitive drum 121)
- Gap between the photosensitive drum 121 and the development roller 83: 0.12 mm
- Gap between the magnetic roller 82 and the development roller 83 0.3 mm
- Surface potential of the photosensitive drum 31: +430 V (at background portion) and +100 V (at image portion)
- Developing bias applied to the development roller 83: Frequency of AC voltage=3.7 kHz, Duty=27%, Vpp=1,500 V, and DC voltage=190 V
- Developing bias applied to the magnetic roller 82: Frequency of AC voltage=3.7 kHz, Duty=73%, Vpp=650 V, and DC voltage=490 V
- Average size of toner particles: 6.8 μm (positively chargeable)

In Example 1, the development roller 83 was disposed such that the lower axial end during the dipping process was positioned toward the front of the developing device 122 (at a position away from the roller gear 83G) as in the embodiment described above. In Comparative Example 1, the development roller 83 was disposed such that the lower axial end during the dipping process was positioned toward the rear of the developing device (at a position toward the roller gear 83G). Example 1 and Comparative Example 1 were each subjected to a process of continuously producing 500K (500×1,000) prints of an image at a coverage rate of 3.8%. Table 1 shows changes in the thickness of the coating layer 83C.

TABLE 1

| | | | Start | 100K Prints | 200K Prints | 300K Prints | 400K Prints | 500K Prints |
|---|---|---|---|---|---|---|---|---|
| Example 1 | Layer Thickness (μm) | Toward Driving Side | 4.0 | 3.8 | 3.6 | 3.5 | 3.4 | 3.3 |
| | | Away From Driving Side | 10.0 | 8.2 | 6.4 | 4.7 | 6.6 | 5.9 |
| | State of Density Inconsistency | | Good | Good | Good | Good | Good | Good |
| Comparative Example 1 | Layer Thickness (μm) | Toward Driving Side | 10.0 | 9.0 | 8.2 | 7.4 | 6.7 | 6.0 |
| | | Away From Driving Side | 4.0 | 3.7 | 3.4 | 3.1 | 2.8 | 2.5 |
| | State of Density Inconsistency | | Acceptable | Acceptable | Poor | Poor | Poor | Poor |

As shown in Table 1, the development roller 83 of Example 1 was disposed such that the lower axial end (initial layer thickness of 10 μm) was positioned away from the driving side where the roller gear 83G was disposed. As a result, the thickness of the coating layer 83C was not below 3 μm upon completion of the process of producing 500K prints. Therefore, stable image forming operation was maintained. On the other hand, the development roller 83 of Comparative Example 1 was disposed such that the upper axial end (initial thickness of 4 μm) was positioned away from the driving side where the roller gear 83G was disposed. As a result, at the time of producing 200K prints and onward, density inconsistency appeared at the intervals corresponding to the rotation pitch of the development roller 83.

In Example 2, in the same manner as the embodiment described above, the aluminum sleeve 830 (base) having a diameter of 20 mm was anodized and then the coating layer 83C was formed to an average thickness of 6 μm on the sleeve 830. The thickness of the coating layer 83C was 10 μm at a portion corresponding to the lower axial end of the development roller 83 during the dipping process. The coating layer 83C was formed from a nylon resin containing 100 parts by mass of titanium oxide dispersed therein. In Comparative Example 2, the aluminum sleeve 830 (base) having a diameter of 20 mm was anodized and then a coating layer was formed by spraying to an average thickness of 6 μm on the sleeve 830. The coating layer of Comparative Example 2 was formed from a urethane resin containing 100 parts by mass of titanium oxide and 5 parts by mass of carbon black dispersed therein. Example 2 and Comparative Example 2 were both subjected to a process of continuously producing 100K (100×1,000) prints of an image at coverage rate of 50%. Table 2 shows changes in the thickness of the respective coating layers.

TABLE 2

| | | | Start | 100K Prints | 200K Prints | 300K Prints | 400K Prints | 500K Prints |
|---|---|---|---|---|---|---|---|---|
| Example 2 | Layer Thickness (μm) | Toward Driving Side | 4.0 | 3.8 | 3.6 | 3.4 | 3.2 | 3.0 |
| | | Away From Driving Side | 10.0 | 9.0 | 8.0 | 7.0 | 6.0 | 5.0 |
| Comparative Example 2 | Layer Thickness (μm) | Toward Driving Side | 6.0 | 5.4 | 4.8 | 4.2 | 3.6 | 3.0 |
| | | Away From Driving Side | 6.0 | 4.0 | 2.0 | 1.0 | 0.0 | 0.0 |

As shown in Table 2, the thickness of the coating layer 83C of Example 2 was not below 3 μm upon completion of continuous 100K prints of an image at a high coverage rate of 50%. Consequently, favorable images were stably formed. On the other hand, the thickness of the coating layer of Comparative Example 2 formed by spraying was reduced at the end portion away from the driving side and worn out by the time of completion of 80K prints. Different from Comparative Example 2, in addition, the coating layer of Example 2 contained titanium oxide as the sole conducting material, which improved the strength of the resulting coating layer and the abrasion amount of the coating layer.

What is claimed is:

1. A developing device comprising:

a housing;

a toner bearing member having a circumferential surface for carrying toner thereon, the toner bearing member being axially rotatable in the housing and disposed a predetermined gap away from an image bearing member, the image bearing member having a circumferential surface on which an electrostatic latent image is formed; and a drive transmission section disposed at one axial end of the toner bearing member and configured to transmit a rotational drive force to the toner bearing member, wherein the toner bearing member includes a cylindrical base and a surface layer disposed over the base, the surface layer is formed through a dipping process of dipping the base into a dipping bath with the base directed axially vertically, the toner bearing member is mounted to the housing such that a lower axial end of the toner bearing member during the dipping process is an opposite axial end to the one axial end at which the drive transmission section is disposed, and the surface layer of the toner bearing member is made from alcohol-soluble nylon only including titanium oxide dispersed therein.

2. The developing device according to claim 1, further comprising:

a developer bearing member having a circumferential surface for carrying developer that contains toner and carrier and supplying the toner to the toner bearing member, the developer bearing member being axially rotatable in the housing and disposed opposite to the toner bearing member;

a developer storing section configured to store developer and disposed in the housing at a position opposite to the developer bearing member; and a conveyance member disposed in the developer storing section so as to be axially rotatable, the conveyance member being configured to convey the developer in a direction from a side corresponding to the one axial end of the toner bearing member to a side corresponding to the opposite axial end of the toner bearing member and to supply the developer to the developer bearing member.

3. The developing device according to claim 2, further comprising:

a layer-thickness limiting member disposed opposite to the developer bearing member and configured to limit a thickness of the developer carried on the developer bearing member;

a developer retaining section disposed at an end of the developer storing section, the end being on the side corresponding to the one axial end of the toner bearing member, the developer retaining section being configured to cause some of the developer to be retained; and a developer discharging section configured to discharge some of the developer retained by the developer retaining section from the housing.

4. The developing device according to claim 1, wherein the base is made from aluminum, the toner bearing member further includes an oxide layer disposed over a surface of the base, and the surface layer is disposed over the oxide layer.

5. An image forming apparatus comprising:

the developing device according to claim 1; and the image bearing member having a circumferential surface on which an electrostatic latent image is formed and configured to receive supply of the toner from the toner bearing member.

6. The image forming apparatus according to claim 5, further comprising a pair of tracking rollers configured to determine the gap between the toner bearing member and the image bearing member.

* * * * *